United States Patent [19]

Jenkins

[11] 4,315,377

[45] Feb. 16, 1982

[54] SINGLE TRIGGER FIRING OF DOUBLE BARREL SIDE-BY-SIDE OR OVER-UNDER FIREARMS

[76] Inventor: Jack J. Jenkins, 462 Stanford Pl., Santa Barbara, Calif. 93111

[21] Appl. No.: 89,629

[22] Filed: Oct. 29, 1979

[51] Int. Cl.[3] ..... F41C 19/00

[52] U.S. Cl. ..... 42/42 R

[58] Field of Search ..... 42/42 R

[56] References Cited

U.S. PATENT DOCUMENTS

| | | | |
|---|---|---|---|
| 2,095,525 | 10/1937 | Mariano | 42/42 R |
| 2,203,378 | 6/1940 | Browning | 42/42 R |
| 2,233,861 | 3/1941 | Browning | 42/42 R |
| 2,361,510 | 10/1944 | Stout | 42/42 R |
| 2,711,042 | 6/1955 | Simmons | 42/42 R |
| 3,142,925 | 8/1964 | Miller | 42/42 R |
| 3,280,494 | 10/1966 | Heiter | 42/42 R |
| 3,421,243 | 1/1969 | Browning | 42/42 R |
| 3,444,640 | 5/1969 | Simmons | 42/42 R |

*Primary Examiner*—Charles T. Jordan

*Attorney, Agent, or Firm*—Cushman, Darby & Cushman

[57] ABSTRACT

A single trigger firing mechanism insertable as an integral unit into operative association with a double barrel side-by-side or over-under firearm is provided, as well as the method of inserting the unit into place. The single trigger of the unit is pivotally mounted at an anterior portion thereof to the firearm for rotation about a first axis. A connector structure having a pair of distinct sear-supporting surfaces thereon for cooperation with a pair of sears of the firearm is mounted by a mounting plate for pivotal movement with respect to the unit about a second axis generally parallel to the first axis, and for tilting movement with respect to the rest of the unit about a third axis generally perpendicular to the first and second axes. A selector is provided for effecting tilting movement of the connector about the third axis to thereby select which of the sears of the pair of sears of the firearm will be released upon trigger actuation. The selector includes a selector button mounted with the trigger, for linear movement in a dimension parallel to the first axis, and accessible outside of the firearm.

14 Claims, 6 Drawing Figures

Fig. 1
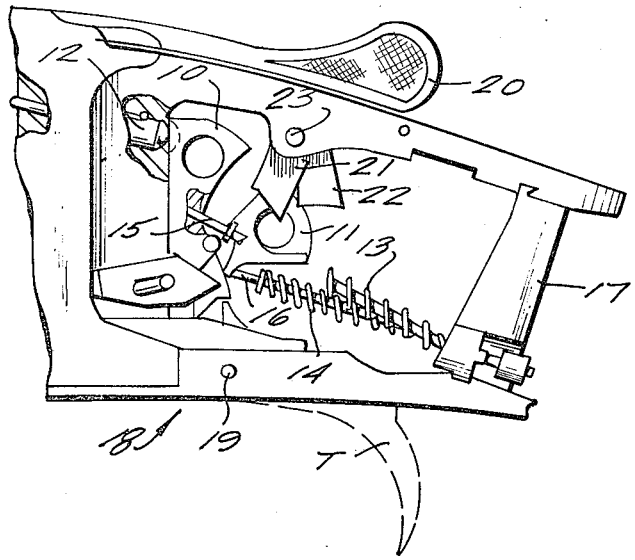
Fig. 3
Fig. 2
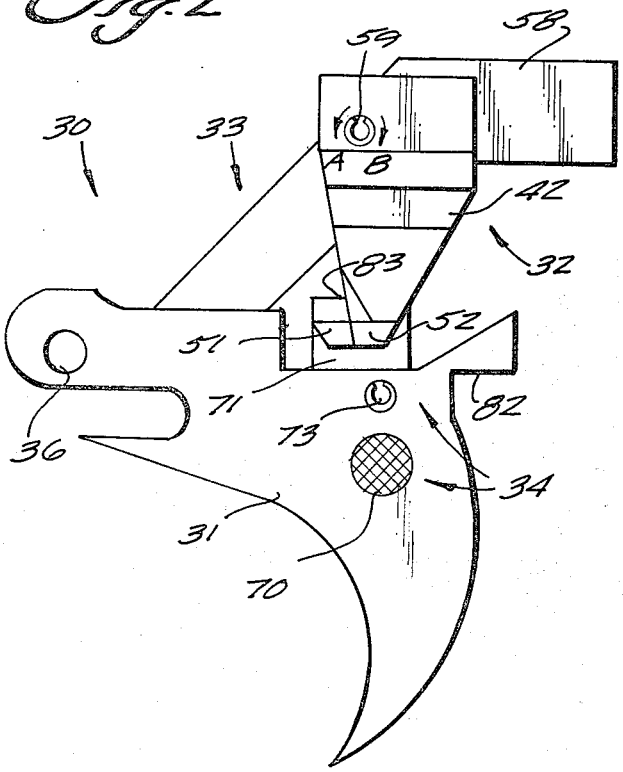
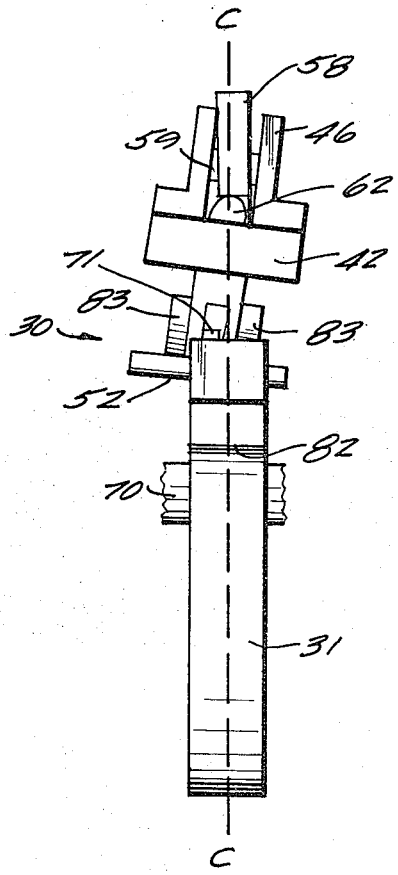

30
33
58
59
60
65
80
63
62
61
48
49
32
83
53
54
55
51
56
52
71
72
34
37
36
82
39
41
73
77
76
75
31
38
40
70

44
46
46
48
32
49
42
43
83
47
83
43
52
51
45
52
51
58
60
59
63
37
71
73
31
74
70

46
46
42
22
47
21
52
51
71

SINGLE TRIGGER FIRING OF DOUBLE BARREL SIDE-BY-SIDE OR OVER-UNDER FIREARMS

BACKGROUND AND SUMMARY OF THE INVENTION

The invention relates to a single trigger firing mechanism, and method of utilization thereof, for use in individually firing the barrels of a double barrel side-by-side or over-under firearm. It is highly desirable to provide a single trigger firing mechanism for double barreled firearms, such as double barreled shotguns, and many prior art arrangements have been proposed for such firearms, such as shown in U.S. Pat. Nos. 2,203,378; 3,142,925; and 2,711,042.

While the prior art single trigger firing mechanisms for double barreled firearms perform their intended functions well, there are a number of drawbacks associated therewith. When such prior art systems are adapted for use in over-under firearms as opposed to side-by-side firearms, it is necessary to completely redesign the units otherwise there is a change in the weight of the trigger pull due to the change in leverage caused by longer or shorter components of the firing mechanism. Also, such mechanisms are relatively complicated to assemble, comprising several components parts which must be separately inserted into the firearm. Conventionally, the selector button for selecting which of the barrels is to be fired first is located on the top of the firearm, opposite the trigger. This location requires the separate insertion of the selector into engagement with the rest of the firing mechanism components, and places the selector mechanism adjacent the breech-opening lever, which may be undesirable.

According to the present invention a simple single trigger firing mechanism is provided which overcomes the drawbacks associated with conventional single trigger firing mechanisms. The firing mechanism according to the present invention is insertable as a single integral unit into operative association with a double barrel firearm. The unit is utilizable with both conventional side-by-side and over-under firearms (and "blitz action" firearms) since there is no change in the weight of the trigger pull due to the change in leverage caused by longer or shorter components of the mechanism. Additionally, the selector button for determining which barrel is to be fired first is mounted with the trigger so that the entire unit can be inserted through a single opening in the bottom of the firearm, and the selector is remote from the breech-opening lever.

According to one aspect of the present invention, a single trigger firing mechanism insertable as an integral unit into operative association with a double barrel side-by-side or over-under firearm having a pair of sears is provided. The firing mechanism consists of: A single trigger having means formed on an anterior portion thereof for mounting it for rotation about a first axis with respect to the firearm. Connector means having a pair of distinct sear-supporting surfaces thereon for cooperation with a pair of sears of the firearm for supporting or releasing the same. Means for mounting the connector means for pivotal movement with respect to the rest of the unit about a second axis generally parallel to the first axis, and for tilting movement with respect to the rest of the unit about a third axis generally perpendicular to the first and second axes. And selector means for effecting tilting movement of the connector means about the third axis to thereby select which of the sears will be released first upon trigger actuation. The selector means comprises a selector button mounted with the trigger and accessible outside of the firearm, and mounted for movement in a dimension parallel to the first axis.

According to another aspect of the present invention, a single trigger firing mechanism for providing individual firing of the barrels of a double barrel side-by-side or over-under firearm having a pair of sears is provided, the mechanism comprising: A trigger, means being formed on an anterior portion of the trigger for mounting it for pivotal movement with respect to the firearm about a first axis. A connector having a pair of distinct sear-engaging surfaces formed thereon, each of the sear-engaging surfaces being capable of being either in sear-releasing or sear-holding mode with respect to the sear of the firearm. A mounting plate having a first end thereof in operative engagement with the trigger and having means associated therewith for mounting the connector thereto for relative movement with respect thereto in response to recoil of the firearm with which the mechanism is associated. Biasing means for biasing the connector into operative engagement with the mounting plate to bias the connector against relative movement with respect to the mounting plate; the connector having sufficient mass relative to the force provided by the biasing means to move relative to the mounting plate against the force of the biasing means in response to recoil of the firearm with which the mechanism is associated. And, a selector mechanism operatively engaging the connector and mounted to act upon the connector to determine which of said connector sear-engaging surfaces will first be in sear-releasing mode and which will first be in sear-holding mode.

Also according to the present invention a method of acting upon a double barrel side-by-side or over-under firearm having a pair of hammers and a pair of sears for holding the hammers in cocked position and having a trigger-receiving opening in the bottom thereof is provided, the method providing that a single trigger may be utilized for providing individual firing of the barrels of the firearm. The method is practiced utilizing an integral unit comprising a single trigger having an anterior portion, a connector having a pair of distinct sear-supporting surfaces, a mounting plate for mounting the connector for movement to select which of the sear-supporting surfaces will first be in a releasing mode with respect to the sear with which it is associated and which will first be in a holding mode, and a selector for moving the connector to select which of the sear-supporting surfaces thereof will be in which position first and including a selector button mounted with the trigger. The method consists essentially of the steps of: Inserting the integral unit through the firearm bottom opening into operative association with the firearm so that the sear-engaging surfaces of the unit connector are in operative association with the sears of the firearm. And, pivotally mounting the trigger to the firearm at the anterior portion of the trigger so that the trigger is pivotally movable to move the connector sear-engaging surface which is in sear-releasing mode with respect to the firearm sear with which it is associated, to release the sear and allow the hammer associated with that sear to fire the barrel with which it is associated.

It is the primary object of the present invention to provide a simple single trigger firing mechanism for a double barrel side-by-side or over-under firearm, and a method of utilization thereof. This and other objects of the invention will become clear from an inspection of the detailed description of the invention and from the appended claims.

BRIEF DESCRIPTION OF THE DRAWINGS

FIG. 1 is a side elevation, partially sectioned and shown in fragmentary view, of conventional components of a side-by-side double barrel shotgun;

FIG. 2 is a side view of an integral unit single trigger firing mechanism according to the present invention, which is utilizable with the shotgun of FIG. 1;

FIG. 3 is a rear view of the unit of FIG. 2;

DETAILED DESCRIPTION OF THE DRAWINGS

Figure 4:
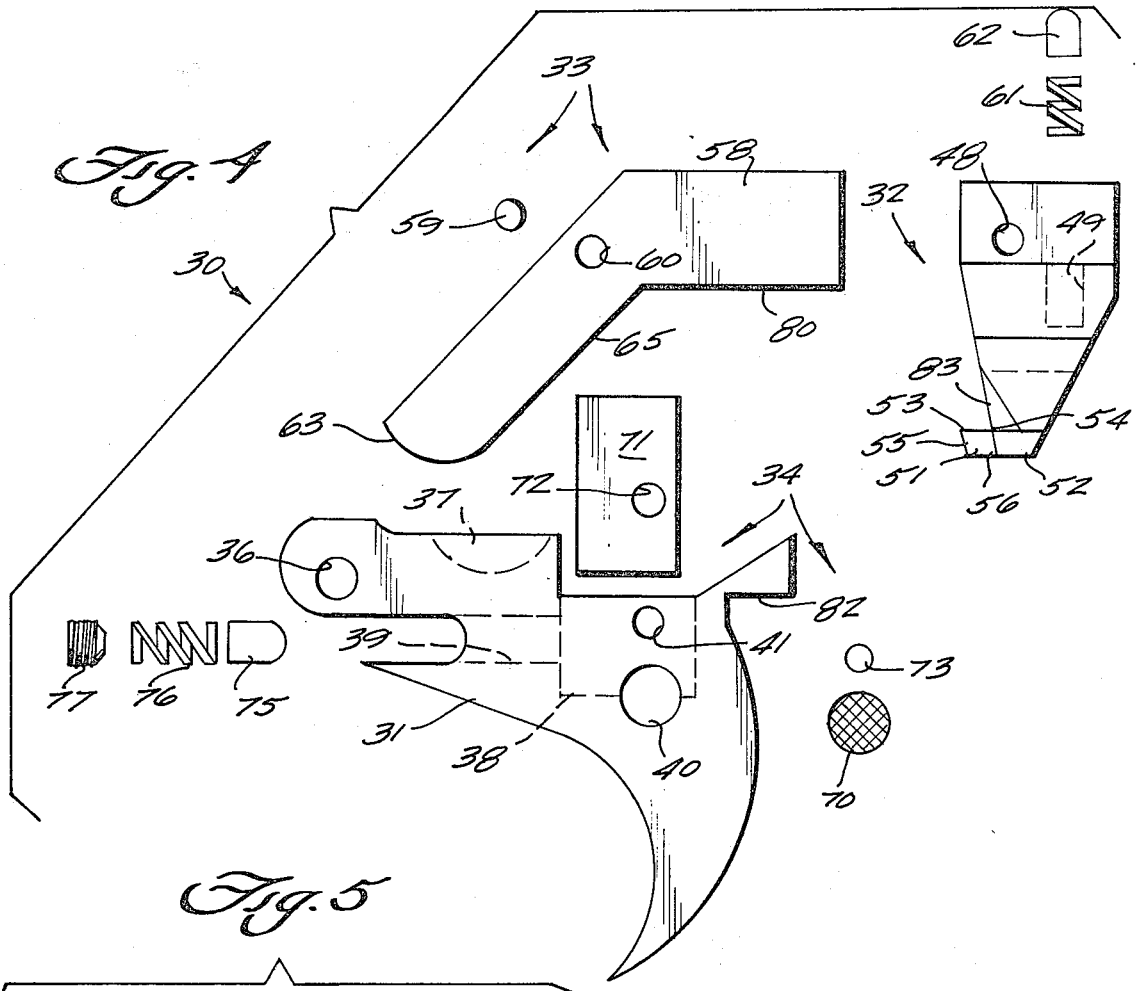
FIG. 4 is a side, exploded view of the unit of FIG. 2, showing each of the individual components thereof.

FIG. 1 schematically illustrates a conventional double barrel firearm with which the firing mechanism according to the present invention is useful. The firearm includes a pair of hammers 10, 11, one associated with a firing pin (e.g. 12) for each of the barrels of the firearm, the hammers normally being spring biased to firing position by the conventional power springs 13, 14 surrounding spring guide rods 15, 16 which are attached at one end thereof to the hammers 10, 11 respectively and at the other end thereof to the stationary tail piece 17 of the firearm. An opening 18 is provided in the bottom of the firearm for receiving a trigger T for pivotal movement about a pivot pin 19, and a breech-opening lever 20 is provided on the top of the firearm for releasing the barrels so that they may be loaded and unloaded with shells. The sears 21, 22 are mounted for pivotal movement about pivot 23, and maintain the hammers 10, 11 respectively in cocked position when supported, and allow the hammers 10, 11 respectively to be released under the bias of the springs 13, 14 when released.

A firing mechanism according to the present invention that is useful for providing single trigger firing of the individual barrels of the firearm of FIG. 1, in turn, is illustrated generally at 30 in FIGS. 2–5. The mechanism 30 is useful with over-under and "blitz action" firearms, as well as with the side-by-side firearm illustrated in FIG. 1. Advantageous features of the mechanism 30 are: it is provided as a single integral unit; it contains a minimum number of parts; it is insertable through the opening 18 in the bottom of the firearm and attachable in place merely by inserting the pivot pin 19 into operative association therewith once inserted through the opening 18; and the selector button for selecting which barrel is to be fired first is mounted with the trigger and is accessible from outside the firearm.

The mechanism 30 includes a single trigger 31, connector means illustrated generally at 32, mounting means illustrated generally at 33, and selector means illustrated generally at 34, as the only component parts thereof. The trigger has means—such as a bore 36—formed on an anterior portion thereof for mounting it for rotation about a first axis, through pivot pin 19, with respect to a firearm with which it is associated. A cavity shown in dotted line at 37 in FIG. 4 is provided in the top of the trigger 31, a cavity indicated in dotted line at 38 is provided in the middle of the trigger 31 as illustrated in FIG. 4, a bore indicated generally in dotted line at 39 in FIG. 4 is provided perpendicular to the bore 36, and two bores 40, 41 are provided in the body of the trigger 31 parallel to the bore 36.

Figure 5:
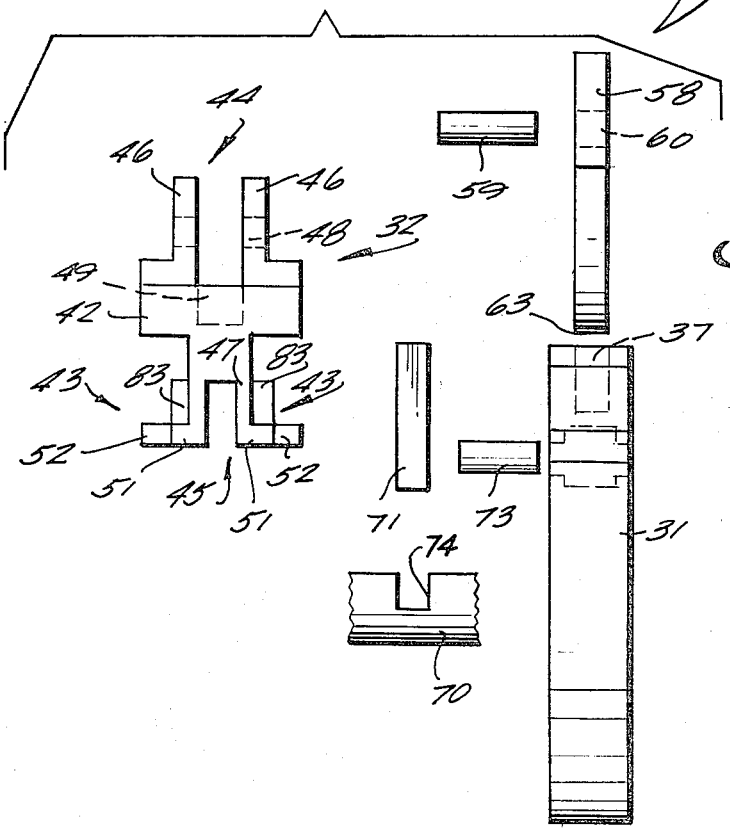
FIG. 5 is an end exploded view of the unit of FIG. 2, showing each of the individual components thereof.

The connector means 32 comprises a body 42 having associated therewith a pair of sear-supporting surfaces indicated generally at 43 in FIG. 5. Each of the sear-supporting surfaces 43 cooperates with one of the sears 21, 22 of the firearm with which the connector means 32 is associated. The body 42 includes first and second yoke assemblies 44, 45 respectively, each of the yoke assemblies having a pair of arms, such as the arms 46 for first yoke assembly 44, and the arms 47 for the second yoke assembly 45. A bore, indicated in dotted line at 48, is provided in each of the arms 46, and a bore—indicated in dotted line at 49—is provided in the body member 42 between the arms 46, transverse to the bores 48.

Each of the arms 47 has one of the sear-supporting surfaces 43 mounted therewith. Each sear-supporting surface 43 comprises a primary hook 51 and a secondary hook 52. As illustrated most clearly in FIGS. 2 and 4, the primary hook 51 has a leading portion 53 thereof closer to the axis of the bore 36 than a leading edge portion 54 of the secondary hook 52, and as illustrated the primary hooks 51 are closer together than the secondary hooks 52 (see FIGS. 5 and 6). Each primary and secondary hook 51, 52 respectively has a slanted cam surface 55, 56 respectively (see FIG. 4) forming the leading edge thereof so that the top of the leading edge is located closer to the axis through the bore 36 than the bottom thereof.

The mounting means 33 includes the mounting plate 58, the pivot pin 59, the bore 60 in the mounting plate 58, and the spring 61 and plunger 62. The mounting plate 58 has a first end 63 thereof that is in abutting engagement with the trigger 31. In the embodiment illustrated in the drawings the first end 63 is adapted to be received by the cavity 37 in the trigger 31. A tight interfering engagement may be provided between the end 63 and the walls defining the cavity 37. Any other suitable mechanism may be provided for maintaining the plate 58 and trigger 31 rigidly together once the mechanism 30 is assembled, such as a weld, solder, glue, holding screw, etc.

The plate 58 is adapted to be received between the yoke arms 46, as illustrated most clearly in FIGS. 2 and 3, and the yoke arms 46 are spaced apart a distance substantially greater than the thickness of the plate 58 at the portion received between the arms 46, so that the arms 46 receive the plate 58 loosely therebetween. The bore 60 in the plate 58 also is larger than the cross-sectional area of the pivot pin 59, although the bores 48 tightly engage the pivot pin 59. This loose receipt of the pin 59 by the mounting plate 58, in loose receipt of the mounting plate 58 by the yoke arms 46, allow tilting movement of the connector means 32 with respect to the trigger 31 and mounting plate 58 about an axis C—C perpendicular to the axis of the bore 36.

Spring 61 and plunger 62 are inserted in the bore 49 in connector 42, and provide yieldable engaging means for maintaining the connector 42 in contact with a stop portion 65 (see FIG. 4) of the mounting plate 58 so that pivotal movement of the connector 42 about the axis of the pivot pin 59 in direction B (see FIG. 2) is prevented, the axis of the pivot pin 59 comprising a second axis which is parallel to a first axis through the bore 36. However, the yieldable engaging means does allow pivotal movement of the connector 42 with respect to the mounting plate 58 in direction A about the second axis against the bias of the springs 61. The connector means 32 has sufficient mass, relative to the force provided by the springs 61, to pivot about the second axis in direction A in response to recoil of the firearm with which the unit is associated after firing of the firearm.

The selector means 34 comprises a selector button (or actuator) 70, a selector plate 71 having a bore 72 therein, and a guide pin 73. The plate 71 is operatively connected to the button 70 by inserting the plate 71 into the groove 74 (see FIG. 5) formed in the button 70. The button 70 has substantially the same diameter as the bore 40 in trigger 31 (see FIG. 4), and the guide pin 73 has substantially the same diameter as the bores 41 and 72. The plate 71 is received within the cavity 38 of the trigger 31, and it is moved in a dimension parallel to the first axis (through bore 36) as the button 70 is moved, the cavity 38 having a larger width than the thickness of the plate 71. Detent means are provided for engaging the plate 71 and holding it in any position to which it has been moved along the guide pin 73. The detent means preferably comprise the plunger 75, spring 76, and retaining screw 77, all of which are disposed in the bore 39 in trigger 31 (see FIG. 4), with the plunger 75 abutting an end surface of the plate 71. The top of the selector plate 71 is received between the arms 47 of the second yoke assembly 45 of the connector 42, the distance between the arms 47 being greater than the width of the selector plate 71.

METHOD OF ASSEMBLY

The component parts of the unit 30 according to the present invention are readily assembleable into the integral unit illustrated in FIGS. 2 and 3. This is readily accomplished by inserting the button 70 through the bore 40 in the trigger 31 so that the groove 74 thereof faces upwardly, inserting the plate 71 into cavity 38 so that it is received by the groove 74, passing the guide pin 73 through the bores 41 and 72, and inserting the plunger 75, spring 76, and retaining screw 77 into the bore 39 so that the plunger 75 engages the front edge of the selector plate 71. Then the spring 61 and plunger 62 are inserted in the bore 49 of the connector 42, the connector 42 is placed over the selector plate 71 so that the top of the selector plate 71 is received between the yoke arms 47, and the mounting plate 58 is placed on top of the connector 42 so that it is received between the yoke arms 46. The first end 63 of the mounting plate 58 is positioned in the cavity 37 of the trigger 31, the bores 48, 60 are lined up, with the plunger 62 engaging the surface 80 (see FIG. 4) of the mounting plate 58, and the pivot pin 59 is passed through the bores 48 and 60. The first end 63 of the mounting plate 58 is then rigidly secured to the trigger 31, such as by an interference fit, glue, welding, etc.

With the unit 30 now assembled, it is ready for insertion into the firearm of FIG. 1. The method of insertion merely consists of the steps of inserting the unit 30 through the firearm bottom opening 18 so that the sear-supporting surfaces 43 (either portions 51 or 52 thereof) are in operative association with the sears 21, 22 of the firearm (see FIG. 6); and pivotally mounting the trigger 31 to the firearm by passing a pin 19 through the bore 36, so that the trigger 31 is pivotally movable to move the sear-engaging surface 51 which is in sear-releasing mode with respect to the firearm sear (21 in FIG. 6) with which it is associated, to release the sear (21) and allow the hammer associated therewith (10) to fire the barrel with which it is associated. The trigger 31 is initially inserted through the opening 18 so that the posterior bottom surface 82 thereof (see FIG. 4) provides a stop for trigger movement against a bottom portion of the firearm surrounding the opening 18.

OPERATION

The operation of selector button 70 is to establish the primary barrel, or that barrel which is to fired first. When the gun is fired, the inertia of the connector 42 causes it to pivot. The fired sear, released by its notch on the hammer, then will drop down, and under hook surface 51, the connector being pulled from underneath the gun sear.

The connector always remains in a position as set by selector button 70. Vertical wall, 83, prevents connector 42 from passing forward and tripping the second sear until the first sear has been tripped. At completion of full recoil of the gun, connector 42 is pulled from engagement with the first sear.

The switch from right to left, or left to right, is automatic within connector 42; vertical wall 83; and sears 21 and 22. To manually select which barrel is to be fired, either right to left in a side by side, or up to down in an over under, the selector button 70 is pressed. The sequence of firing right to left will remain fixed, as it will in an over under up to down, until selector button 70 is pressed to the opposite side, whereby the sequence of firing will be reversed, and will remain fixed left to right, or in an over under, down to up, until button 70 is again pressed, to again reverse the firing sequence.

At the moment the action and firing mechanism is cocked and prepared to fire the first barrel, both sears are located above the hook 51. Vertical wall 83 prevents connector 42 from falling forward as it is biased by spring 61, as it bears against sear 21 or sear 22. When trigger 31 is pulled and the gun is fired, then the inertia of the connector 42 overcomes the bias of spring 61, releasing sear 21 to drop below hook 51. Connector 42 can now pass further forward, not being opposed by vertical wall 83, and, biased by spring 61, where it now engages under the second sear with hook 54. A second pull of trigger 31 will now release second sear 22, which is engaged with hook 54.

Figure 6:
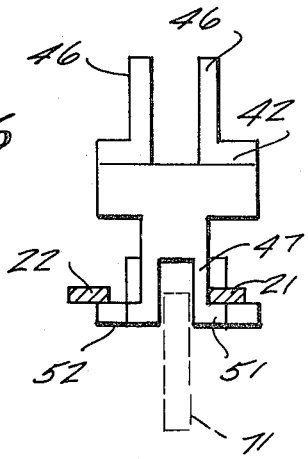
FIG. 6 is a front view of the connector of the unit of FIGS. 2–5, schematically illustrating the connector in operative association with the sears of the shotgun of FIG. 1.

The spacing of the sears as shown in FIG. 6, is such that clearance is provided between the sears. This will position one sear or the other in front of vertical wall 83, depending upon the position of button 70. This positions connector 42, either in right mode or left mode, so that the sequence of operation of connector 42 is either left to right, or right to left, upon firing.

Cocking the gun will also cock the trigger, and return both sears to their position above hook(s) 51.

It will thus be seen that according to the present invention a simple single trigger firing mechanism for double barrel firearms has been provided, which mechanism is insertable as an integral unit into operative association with the firearm in a simple and easy manner. The unit consists of a minimum of components and is easy to make, assemble, and install, and provides a selector button on the trigger. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent mechanisms and methods.

I claim:

1. A single trigger firing mechanism insertable as an integral unit into operative association with a double barrel side-by-side or over-under firearm having a pair of sears, said integral unit firing mechanism consisting essentially of a single trigger having means formed on an anterior portion thereof for mounting it for rotation about a first axis with respect to a firearm with which it is associated;

connector means having a pair of distinct sear-supporting surfaces thereon for cooperation with the pair of sears of the firearm with which said connector means is associated for supporting or releasing same;

means for mounting said connector means for pivotal movement, with respect to the rest of the unit, about a second axis generally parallel to said first axis, and for tilting movement, with respect to the rest of the unit, about a third axis generally perpendicular to said first and second axes; and selector means for effecting tilting movement of said connector means about said third axis to thereby select which of the sears of the pair of sears of the firearm with which the unit is associated will be released first upon trigger actuation, said selector means comprising: a selector actuator mounted with said trigger and accessible outside of the firearm with which the unit is associated; a selector plate operatively mounted to said selector actuator and means for guiding linear movement of said plate in a dimension parallel to said first axis; a bore in said trigger extending parallel to said first axis and mounting said selector actuator for linear movement in said bore in a dimension parallel to said first axis; and detenting means for maintaining said plate in a position to which it has been moved in said dimension of movement thereof.

2. An integral unit firing mechanism as recited in claim 1 wherein said means for mounting said connector means comprises a mounting plate in abutting engagement with said trigger at a first end of said mounting plate; a pivot pin extending parallel to said first axis, and along said second axis, and extending through cooperating bores formed in both said mounting plate and said connector means; and yieldable engaging means for maintaining said connector means in contact with a stop portion of said mounting plate so that pivotal movement of said connector means about said second axis in a first direction is prevented, but for allowing pivotal movement of said connector means with respect to said mounting plate about said second axis against a spring bias in a second direction; said connector means having sufficient mass relative to the force provided by said spring bias to pivot about said second axis in said second direction in response to recoil of the firearm with which the unit is associated after firing of the firearm.

3. An integral unit firing mechanism as recited in claim 2 wherein said connector means comprises first and second yoke assemblies, each yoke assembly comprising first and second yoke arms, the yoke arms of said first yoke assembly receiving a portion of said mounting plate therebetween, and said pivot pin extending through bores in both yoke arms of said first yoke assembly and through a bore in said mounting plate received between said yoke arms; and wherein said bore in said mounting plate is substantially larger than the cross-sectional area of said pivot pin to loosely receive said pin therein while each of the bores in said yoke arms tightly receive said pivot pin therein; and wherein the distance between said yoke arms of said first yoke assembly along said second axis is substantially greater than the thickness of the portion of the mounting plate received therebetween so that said mounting plate is loosely received therebetween.

4. An integral unit firing mechanism as recited in claim 4 wherein said yoke arms of said second yoke assembly receive said selector plate therebetween, and wherein the distance between said yoke arms of said second yoke assembly is substantially greater than the thickness of the portion of said selector plate received therebetween.

5. An integral unit firing mechanism as recited in claim 4 wherein one of said sear-supporting surfaces is integral with each of said yoke arms of said second yoke assembly; each of said sear-supporting surfaces comprising a primary hook and a secondary hook, said primary hook having a leading portion thereof closer to said first axis than a leading portion of said secondary hook and being closer to said selector plate than said secondary hook; and said secondary hook and said primary hook both having a slanted cam surface forming the leading edge thereof so that the top of the leading edge of each is located closer to said first axis than the bottom of the leading edge.

6. An integral unit firing mechanism as recited in claim 3 wherein said yieldable engaging means comprises a spring-biased plunger mounted in said connector means with said plunger extending outwardly from said connector means between said yoke arms of said first yoke assembly and abutting a portion of said mounting plate on the opposite side of said second axis as said first end thereof.

7. An integral unit firing mechanism as recited in claim 4 wherein said sear-supporting surfaces comprise a primary hook and a secondary hook, said primary hook having a leading portion thereof closer to said first axis than a leading portion of said secondary hook; and said secondary hook and said primary hook both having a slanted cam surface forming the leading edge thereof so that the top of the leading edge of each is located closer to said first axis than the bottom of the leading edge.

8. A single trigger firing mechanism for providing individual firing of the barrels of a double barrel side-by-side or over-under firearm having a pair of sears, said mechanism comprising a trigger, means being formed on an anterior portion of said trigger for mounting said trigger for pivotal movement with respect to the firearm with which it is associated, about a first axis;

a connector having a pair of distinct sear-engaging surfaces formed thereon, each of said sear-engaging surfaces being capable of being either in sear-releasing or sear-holding mode with respect to the sear of the firearm with which said mechanism is associated;

a mounting plate having a first end thereof in operative engagement with said trigger, and having means associated therewith for mounting said connector thereto for relative movement with respect thereto in response to recoil of the firearm with which said mechanism is associated;

biasing means for biasing said connector into operative engagement with said mounting plate to bias said connector against relative movement with respect to said mounting plate; and said connector having sufficient mass relative to the force provided by said biasing means to move relative to said mounting plate against the force of said biasing means in response to recoil of the firearm with which said mechanism is associated.

9. A mechanism as recited in claim 8 wherein said mounting plate is in abutting engagement with said trigger at a first end of said plate; and wherein said means for mounting the connector to the mounting plate comprises a pivot pin extending parallel to said first axis, and along a second axis generally parallel to said first axis, and extending through cooperating bores formed in both said mounting plate and said connector; and said biasing means maintaining said connector in contact with a stop portion of said mounting plate so that pivotal movement of said connector about said second axis in a first direction is prevented, but so that pivotal movement of said connector with respect to said mounting plate about said second axis against a spring bias in a second direction is allowed.

10. A mechanism as recited in claim 9 wherein said connector comprises a first yoke assembly comprising first and second yoke arms, the yoke arms of said first yoke assembly receiving a portion of said mounting plate therebetween, and said pivot pin extending through bores in both yoke arms of said first yoke assembly and through a bore in said mounting plate received between said yoke arms; and wherein said bore in said mounting plate is substantially larger than the cross-sectional area of said pivot pin to loosely receive said pin therein while each of the bores in said yoke arms tightly receive said pivot pin therein.

11. An integral unit firing mechanism as recited in claim 10 wherein said biasing means comprises a spring-biased plunger mounted in said connector means with said plunger extending outwardly from said connector means between said yoke arms of said first yoke assembly and abutting a portion of said mounting plate on the opposite side of said second axis as said first end thereof.

12. A mechanism as recited in claim 8 and further comprising:

a selector mechanism operatively engaging said connector and mounted to act upon said connector to determine which of said connector sear-engaging surfaces will first be in sear-releasing mode and which will first be in sear-holding mode.

13. A mechanism as recited in claim 12 wherein said selector comprises a second yoke assembly having a pair of yoke arms with one of said sear-supporting surfaces integral with each of said yoke arms; each of said sear-supporting surfaces comprising a primary hook and a secondary hook, said primary hook engaging the sear with which said surface is associated when said surface is in the sear-releasing mode, and said secondary hook engaging the sear with which said surface is associated when said surface is in the sear-holding mode; said primary hook having a leading portion thereof closer to said first axis than a leading portion of said secondary hook; and said primary hooks being disposed on the insides of said yoke arms while said secondary hooks are disposed on the outsides of said yoke arms, being spaced further from each other than are said primary hooks from each other.

14. A mechanism as recited in claim 13 wherein said relative movement of said connector with respect to said mounting plate in response to firearm recoil is relative movement in a first mode, and wherein said mounting plate mounts said connector for relative movement with respect thereto in a second mode, different from said first mode; and wherein said selector mechanism acts upon said connector to move it in said second mode, said selector mechanism including a selector element received between said yoke arms of said second yoke assembly and also received within, and guided for movement with respect to, said trigger.

* * * * *